US011441286B2

(12) United States Patent
Sotelo

(10) Patent No.: US 11,441,286 B2
(45) Date of Patent: Sep. 13, 2022

(54) CHAIR FOR SUPPORTING REINFORCING ELEMENTS

(71) Applicant: Oscar Sotelo, McAllen, TX (US)

(72) Inventor: Oscar Sotelo, McAllen, TX (US)

( * ) Notice: Subject to any disclaimer, the term of this patent is extended or adjusted under 35 U.S.C. 154(b) by 229 days.

(21) Appl. No.: 16/818,974

(22) Filed: Mar. 13, 2020

(65) Prior Publication Data

US 2020/0291596 A1 Sep. 17, 2020

Related U.S. Application Data

(60) Provisional application No. 62/819,520, filed on Mar. 16, 2019.

(51) Int. Cl.

| | |
|---|---|
| ***E02D 27/01*** | (2006.01) |
| ***A47C 5/00*** | (2006.01) |
| ***E04C 5/16*** | (2006.01) |
| ***E04C 5/20*** | (2006.01) |

(52) U.S. Cl.

CPC ..... *E02D 27/016* (2013.01); *A47C 5/00* (2013.01); *E04C 5/168* (2013.01); *E04C 5/20* (2013.01)

(58) Field of Classification Search

CPC ..... E02D 27/016; E04C 5/168; E04C 5/20

See application file for complete search history.

(56) References Cited

U.S. PATENT DOCUMENTS

| | | | | |
|---|---|---|---|---|
| 3,387,423 | A * | 6/1968 | Andersen | E04C 5/20 52/678 |
| 4,060,954 | A | 12/1977 | Liuzza | |
| 4,498,270 | A | 2/1985 | Ilukowicz | |
| 4,831,803 | A * | 5/1989 | Leonardis | B65D 5/006 52/323 |
| 5,014,485 | A * | 5/1991 | Chang | E04C 5/168 52/678 |
| D354,218 | S | 1/1995 | Van de Peer | |
| 6,089,522 | A | 7/2000 | Haslem | |
| 6,212,848 | B1 * | 4/2001 | Cooper | E04C 5/168 404/135 |
| 6,345,474 | B1 * | 2/2002 | Triplett | E02D 27/01 405/229 |
| 6,732,484 | B1 * | 5/2004 | Sotelo | E04C 5/167 52/677 |
| D500,243 | S * | 12/2004 | Turek | D8/354 |
| 7,028,443 | B2 * | 4/2006 | Bennett | E04C 5/166 52/686 |
| D548,055 | S | 8/2007 | Erickson | |
| D548,056 | S * | 8/2007 | Erickson | D8/354 |
| 8,099,925 | B1 | 1/2012 | Coons | |
| 8,505,267 | B2 * | 8/2013 | Martin Hernandez | E04B 5/43 52/749.11 |
| D706,608 | S | 6/2014 | Offermann | |

(Continued)

*Primary Examiner* — Paola Agudelo

(74) *Attorney, Agent, or Firm* — G. Turner Moller

(57) ABSTRACT

A concrete chair elevates rebar above an underlying surface. The chair includes a rectilinear rim having a length, width and height of different distance. The rim may be oriented so each side abuts the underlying surface so rebar can be supported at three different heights above the underlying surface. In a foundation pour, the chair supports rebar at three different elevations. In a tilt wall pour, the chair supports rebar at three different elevations and produces a mark on the cured wall of considerably reduced extent.

20 Claims, 2 Drawing Sheets

(56) References Cited

U.S. PATENT DOCUMENTS

| | | | | |
|---|---|---|---|---|
| 2008/0028718 | A1* | 2/2008 | Erickson | E04C 5/206<br>52/687 |
| 2010/0146889 | A1* | 6/2010 | Pontarolo | E02D 27/01<br>52/295 |
| 2011/0214382 | A1* | 9/2011 | Alfonso | E04C 5/168<br>52/687 |
| 2012/0011799 | A1* | 1/2012 | Beaumont | E04C 5/20<br>52/686 |

* cited by examiner

CHAIR FOR SUPPORTING REINFORCING ELEMENTS

This invention relates to a chair for supporting rebar during a concrete pour.

BACKGROUND OF THE INVENTION

Concrete is poured in many different situations for many different purposes. In many concrete pours, metal reinforcements known as rebar are used to increase the strength of the cured concrete. By itself, concrete is impressively strong in compression but surprisingly weak in tension. Including metal rebar in concrete increases tensile strength substantially thereby allowing concrete to be used in many situations.

The most common concrete pour is a foundation for residential homes, apartments and commercial buildings. Concrete is poured into a perimeter trench and one or more interior intersecting trenches and onto a horizontal rebar grid overlapping the trenches. In the horizontal section, lengths of rebar are laid in intersecting perpendicular rows that are typically tied together. Rebar is supported off the underlying ground surface by what the industry calls chairs. The purpose of chairs is to support the rebar at an elevation that falls inside the thickness of the concrete and is not too close to the top or bottom. In the perimeter and interior trenches, chairs are also used to elevate an assembly of vertical rebar from the bottom of the trench. The pour may be made onto the underlying ground surface or may be made onto a plastic sheet suitable for this purpose.

A second type common concrete pour is for a tilt wall where concrete is poured onto a horizontal mold resting on the underlying concrete foundation of a building. After the concrete cures, the mold is removed and the wall tilted to a vertical position and secured to the foundation. Suitable joists or beams connect the vertical walls and provide a support for the building roof. One peculiarity of tilt wall type pours is that chairs leave marks on the underside of the wall and thus leave a mark on either the inside or the outside of the cured or finished wall.

Although the most commonly used rebar chair is a piece of brick, the prior art is replete with many different styles and types of more sophisticated chairs. Typical disclosures are found in U.S. Pat. Nos. 3,387,423; 4,060,954; 4,498,270; 4,831,803; 5,014,485; 6,089,522; 6,732,484 and 8,099,925; United States Printed Patent Applications 2010/0146889 and 2012/0011799 and U.S. Design Pat. Nos. D354,218; D548,055; D548,056 and D706,608.

SUMMARY OF THE INVENTION

The chair of this invention is provided to support rebar in a variety of situations involving a horizontal foundation or ground pour or a tilt wall pour and is thus a more universal device. In one embodiment, a chair provides configurations for a foundation pour where the rebar can be supported at three different elevations and provides configurations for a tilt wall pour where the rebar can also be supported at three different elevations.

In one embodiment, the chair is preferably a rectangular box like shape having a long dimension, a width dimension and a height dimension, all of which may be different to provide different heights for the plane of rebar supported by the chair. Interior braces prevent the box from distorting due to the load of concrete. In some embodiments, chairs may be stacked to increase the rebar height over what is available from use of only one chair. In some embodiments, feet or rails are provided to be positioned down in tilt wall pours and up in ground pours. The feet or rails, when down, desirably leave a very small mark on the cured wall.

DETAILED DESCRIPTION OF THE INVENTION

Figure 1:
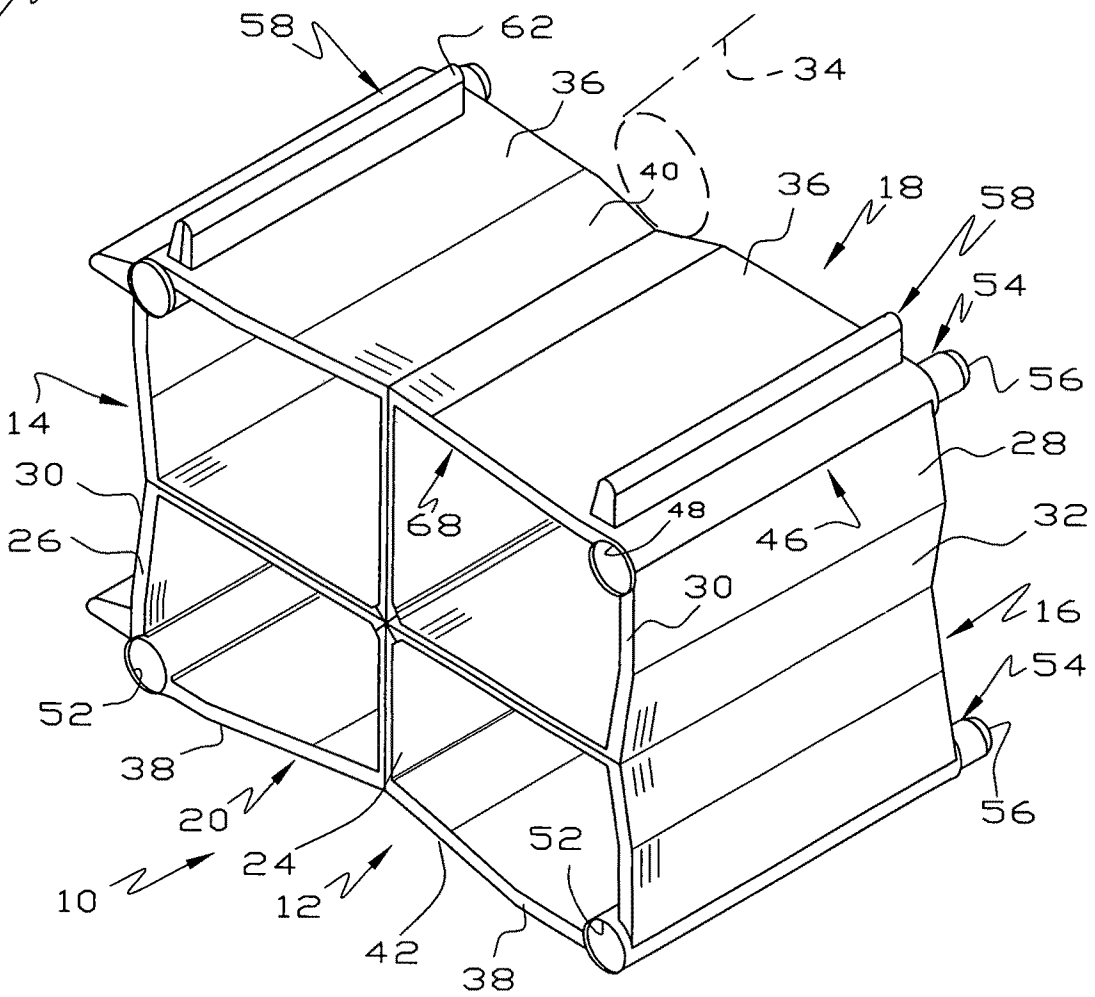
FIG. 1 is an isometric view of one embodiment of a chair illustrated in an orientation used in a foundation or ground pour where one of the sides provides spacing of rebar from an underlying surface, as viewed from a socket end of a stacking mechanism.

The chair 10 is of generally rectangular shape providing a length dimension which is its longest dimension, a height dimension and a width dimension, all of which are of different distance or linear extent to provide different rebar elevations from an underlying surface. Because the height and width dimensions depend on which side is up, this terminology is used as an example for descriptive purposes. Because the chair 10 may be used in any orientation, the terms top and bottom are arbitrary as are upwardly and downwardly.

Referring to FIGS. 1-4, one embodiment of the invention is a chair 10 comprising a rectilinear box or rim 12 having a pair of generally parallel end walls 14, 16 and a pair of generally parallel side walls 18, 20 intersecting and joined to the end walls 14, 16. As will become apparent, each wall provides a depression for supporting a concrete reinforcing element or rebar. In addition, the walls provide upwardly and downwardly facing edges having a depression used to support concrete reinforcing elements or rebar. In one embodiment, a total of six different rebar supporting depressions may be created. As will become more apparent hereinafter, three of these positions may be used in a foundation pour mode and three may be used in a tilt wall pour mode.

One or more braces or struts 22, 24 extend between opposite walls and act to prevent or minimize distorting of the walls 14, 16, 18, 20 reacting against wet concrete poured into the chair 10. The walls 14, 16 may preferably include coplanar sections 26, 26 interrupted by a V-shaped section or notch 30, 32 of sufficient depth to hold and support a reinforcing element or rebar 34 when the appropriate end wall is horizontal. The side walls 18, 20 may preferably include coplanar sections 36, 38 interrupted by a V-shaped section or notch 40, 42 of sufficient depth to hold and support rebar 34 when the rim 12 is oriented appropriately. The braces 22, 24 may intersect at the apex of the notch V to more effectively transmit loads between the walls 14, 16, 18, 20 and the braces 22, 24.

As more fully apparent hereinafter, the walls 14, 16, 18, 20 are basically flat providing a large surface area in contact with the underlying surface thereby promoting stability in a foundation pour mode.

The angle 44 of the notches 30, 32, 40, 42 is subject to wide variation and may be different but the angles 44 may typically all be the same and may be between 80-170° or more preferably between 120-160°, as discussed more fully hereinafter in conjunction with FIG. 5. An ideal value of the angle 44 may be in the 130-150° range. The notches 30, 32, 40, 42 allow rebar of any reasonable size to be supported in any orientation of the chair 10 and also allow some shifting of rebar 34 relative to the chair 10 or some shifting of the chair 10 relative to the underlying surface.

Figure 2:
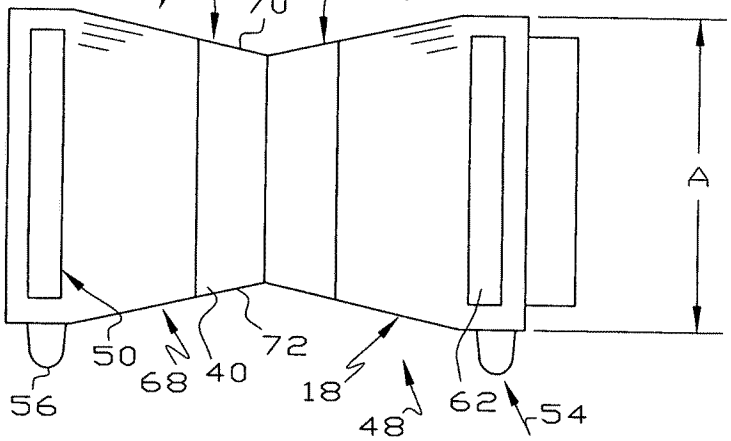
FIG. 2 is a side view of the chair of FIG. 1 illustrating another orientation used in a tilt wall pour where the height of the chair provides spacing of rebar from an underlying surface.
Figure 4:
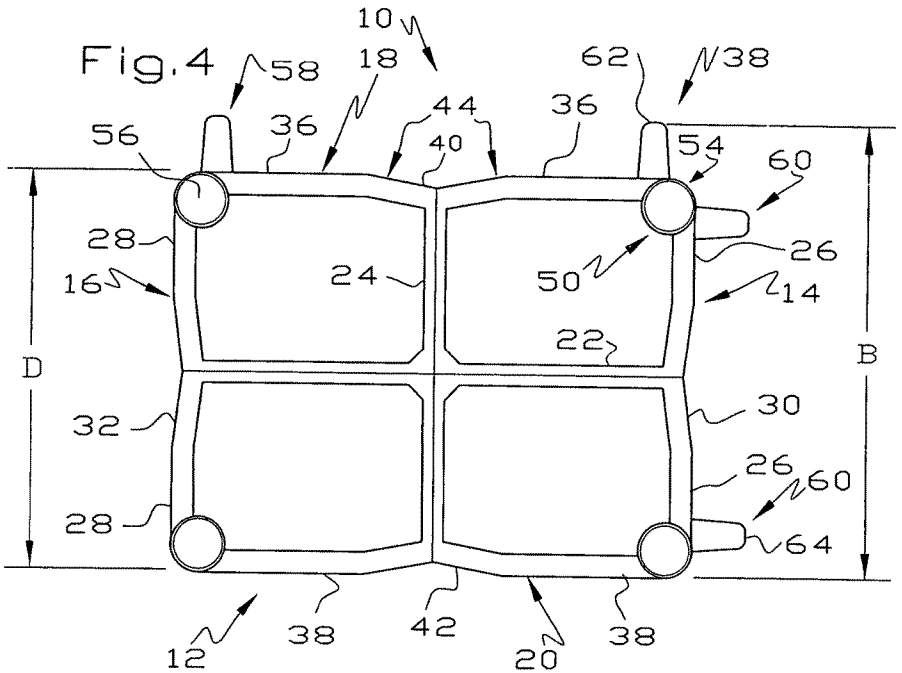
FIG. 4 is a bottom view of the chair of FIGS. 1-3, as viewed from a pin end of a stacking mechanism.

The top 46 and the bottom 48 of the chair 10 may preferably be open as shown by a comparison of FIGS. 2 and 4 to allow wet concrete to enter the chair 10 and flow through the chair 10. In the embodiment illustrated, it will be seen that one of the notches 30, 32, 42, 44 is on the underside of the chair 10 when one of the flat sides of the rim 12 adjoins the underlying surface as in a foundation pour mode. This allows wet concrete to flow under the chair 10 even though the chair 10 is supported on the underlying surface.

The end and side walls 14, 16, 18, 20 are connected by corner structures 50 which are illustrated as being columnar or circular in cross-section although many other suitable shapes exist. One advantage of the corner structures 50 is to reinforce the joint between the end walls 12, 14 and the side walls 16, 18. Concrete flowing through the chair 10 is dynamic and unpredictable, meaning that forces can be applied to spread the joint or flatten it. One advantage of the corner structures 50 is to act as gussets to strengthen or stabilize the corner joints.

The corner structures 50 may each include a socket 52 on the top each corner and a pin, peg or foot 54 projecting from the bottom of each corner. The feet 54 may be tapered slightly to fit easily in the sockets 52 so the chairs 10 can be stacked to increase the height of rebar 34 in the stacked configuration. The height of the rebar 34 may accordingly be multiples of the height dimension of the chair 10.

The feet 54 have another important advantage in the tilt wall pour configuration in which the feet 54 are down against a slick plastic sheet on the underlying surface. When concrete is poured into the wall mold, the feet 54 support the rebar 34 from the sheet but there is an area under the feet 54 where no concrete can reach. This leaves a mark on the tilt wall which must be covered later, as with stucco, plaster, filler or the like. The feet 54 taper to a smooth generally hemispherical point 56 to minimize the mark of the chair 10 on the cured tilt wall.

The chair 10 also includes a first set of spaced rails or feet 58 extending away from only one of the side walls 18, 20 and a second set of spaced rails or feet 60 extending away from only one of the end walls 14, 16. In the illustrated embodiment, the rails 58 are on the side wall 18 and the rails 60 are on the end wall 14. The rails 58, 60 have one of the same advantages as the feet 54, i.e. in a tilt wall pour, the mark of the chair 10 on the cured wall is minimized. The rails 58, 60 may accordingly be a more-or-less continuous support terminating in a more-or-less hemispherical smooth edge 62, 64. When the chairs 10 are placed in a tilt wall mold on a slick plastic sheet with the rails 58 down, rebar 34 may be placed in the notch 42. When concrete is poured and cured, the only mark on the cured tilt wall is left by a trace of the edges 62. This mark on the tilt wall may be covered, as with stucco, plaster, filler or the like and is much smaller than if the entire side wall or end wall were supported on the underlying surface. This clearly makes the cosmetic clean up simpler, easier and less time consuming thereby reducing costs. The feet 58, 60 are conveniently attached to the side wall 18 and end wall 14. In the alternative, the feet 60 may simply span the distance between the adjacent side walls 18, 20, leaving an end of the rim 12 open but this eliminates use of this side as a rebar support.

An advantage of the feet 58, 60 is leaving a very small mark on the cured wall in a tilt wall type pour. The size of this mark may be compared to the area of the flat spots on the wall opposite the feet or on the area of the opposite wall. The mark may be no more than 40% of the size of the flat part of the opposite wall, may preferably be less than 12% of the size of the flat part of the opposite wall and may ideally be less than 6%. It will be apparent this reduces the cost of cosmetically repairing a cured wall in a tilt pour.

If the side walls 18, 20 or end walls 14, 16 were adjacent the underlying mold surface, a mark would be left on the cured wall of the size of the flat sections 36, 38, 26, 28. In one size prototype, measuring 2½" wide×3" high×4" long, the flat sections 36, 38 on the side walls are approximately 7 square inches and the flat sections on the end walls are about 5 square inches. In this prototype, the rails 58 are about 4" long and have a bearing surface against the mold of about 0.04", meaning the mark left by the prototype is about 4"×2 rails×0.04"=0.32 square inches. Thus, the size of the mark on the cured tilt wall is about 0.32/7 or about 5% of the area of the flat sections 36 of the side wall 18. In the case of the end walls 16, the bearing area of the feet 60 is about 3"×2×0.04" or about 0.24 square inches. Thus, the size of the mark on the cured tilt wall is about 0.24/5 or about 5% of the area of the flat sections 28 of the end wall 16 or less when compared to the area of the end wall 16.

The size of the mark compared to the area of the flat spots is affected by the width of the notch in the wall and is thus more variable than the area of the adjoining wall. The size of the mark may be below 35% of the area of the adjoining wall and may preferably be below 10% and may ideally be below 5%. In the case of one embodiment measuring 2½ inches high, 3 inches wide and 4" long, the feet on the side wall 18 have a mark of 0.32 square inches which is 0.32/12 which is about 3% and the feet on the end wall 14 leave a mark of about 0.24 square inches which is 0.24/7.5 also about 3%.

The side walls 18, 20 include opposite edges 66, 68 which incline to provide a notch 70, 72 for supporting a rebar 34 when the feet 54 are up or down. The angle 74 of the notches 70, 72 may be of the same order of magnitude as the angle 44. The end walls 14, 16 also include opposite edges 76, 78 which incline to provide a notch 80, 82 for supporting rebar 34 when the feet 60 point up or down. The angle 84 of the notches 80, 82 may be of the same order of magnitude as the angles 44, 74.

Figure 5:
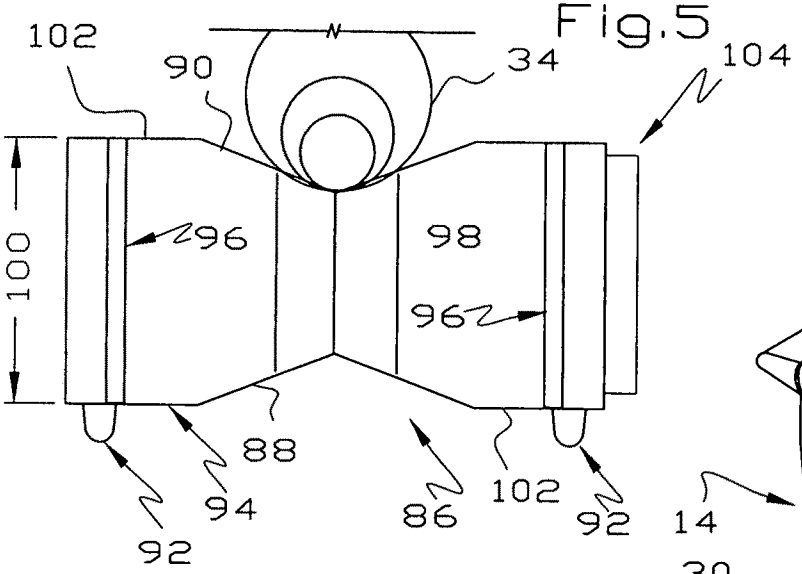
FIG. 5 is a view of another embodiment illustrating a rebar supporting depression of different shape.

FIG. 5 illustrates another embodiment 86 of a chair showing more pronounced notches 88, 90 for receiving rebar 34. The embodiment 86 includes feet 92 supporting the bottom edge 94 from the underlying surface and feet 96 supporting the side wall 98 from the underlying surface when the chair 86 is appropriately oriented. The height of the rebar 34 from the underlying surface is not exactly equal to the dimension 100 because of the relation-ship between the size of the rebar 34 and the notch 90. The illustration of FIG. 5 represents a long side of the prototype where the long side is 4" long. The shape of the shorter side will be similar but not identical because of the difference in the length of the segments 102. The depression caused by the angle 40 and the radius of the rebar 34 are often very similar and offset one another and may accordingly be ignored for many purposes and are ignored for the following discussion. The advantage of the deeper notches 88, 90 is the notch adjoining the underlying surface produces less frictional forces against concrete movement into and out of the rim 12 thereby allowing better circulation of wet concrete. To put the size of the notches 88, 90 in perspective, each is about 30-45% of the height of the wall 98. As in the chair 10, the chair 86 may include rails or feet 104 so the chair 86 also has advantageous tilt pour features.

In a tilt wall pour, there are several rebar heights available by use of the chairs 10. With the feet 54 down as shown in FIGS. 2 and 5, the rebar 34 will at about the sum A of the height of the end walls 14, 16 plus the height of the feet 54. As shown in FIG. 4, with the side wall 18 down, rebar 34 will be at about the sum B of the width of an end wall 16 plus the height of the rails 58. With the wall 14 and rails 60 down, the rebar will be at about the sum C of the length of a side walls 16 plus the height of the rails 60. With chairs 10 stacked on top of another, the rebar 34 will be at a multiple of the height of the chair 10 plus the height of one set of feet 54. A single chair 10 provides at least three rebar heights. By stacking the chairs 10, many different rebar heights can be achieved.

In a foundation pour mode, there are several rebar heights available by use of the chair 10. With the side wall 20 down, the height of the rebar 34 will be basically the width D of a side wall 16 as may be envisioned from FIG. 4. With the end wall 16 down, the height of the rebar 34 will be basically the length E of a side wall 18 as may be envisioned from FIG. 3. With the top 46 down, the height of the rebar 34 will be basically the height F of a side wall 18 as may be envisioned from an upside-down version of FIG. 2. With chairs 10 stacked on top of each another and the top 46 down, the rebar 34 will be at a multiple of the height of a side walls 18. Accordingly, the chair 10 provides at least three rebar heights D, E, F for a foundation pour. By stacking the chairs 10, many different rebar heights can be achieved.

Although the exact dimensions of the height, width and length of the chair 10 is subject to wide variation, one suitable embodiment is 2½ inches high plus the feet 54 measuring three eighths inch, 3" wide and 4" long. In this version, the following rebar heights are achieved:

| tilt wall pour | foundation pour |
|---|---|
| A = 2⅞ inches | D = 2½ inches |
| B = 3⅜ inches | E = 3 inches |
| C = 4⅜ inches | F = 4 inches |

These distances assume the size of the rebar exactly offsets the depth of the notch. In other situations, an adjustment needs to be made for the size of the rebar and the inclination of the notch, all as discussed in conjunction with FIG. 5.

The chair 10 is of a configuration that can be manufactured by injection molding of conventional polymers and is thus susceptible of low cost production.

It will be apparent that the embodiment of FIGS. 1-5 is a special case of a six sided polygon in which any of the six sides may be placed on an underlying surface to support rebar at any of six different heights above an underlying surface. It is equally apparent that other multisided polygons may be employed to support rebar where one side of the polygon adjoins an underlying surface and an opposite side supports rebar. In this fashion many different rebar heights may be achieved. A major difficulty with polygons with a greater number of sides is to construct a sturdy structure that can be economically manufactured.

Figure 6:
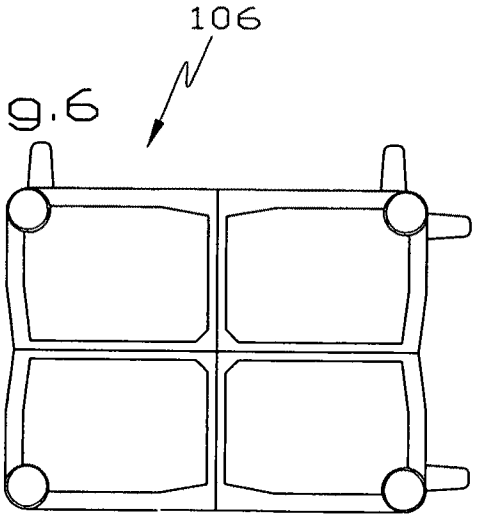
FIG. 6 is a view of another embodiment.
Figure 3:
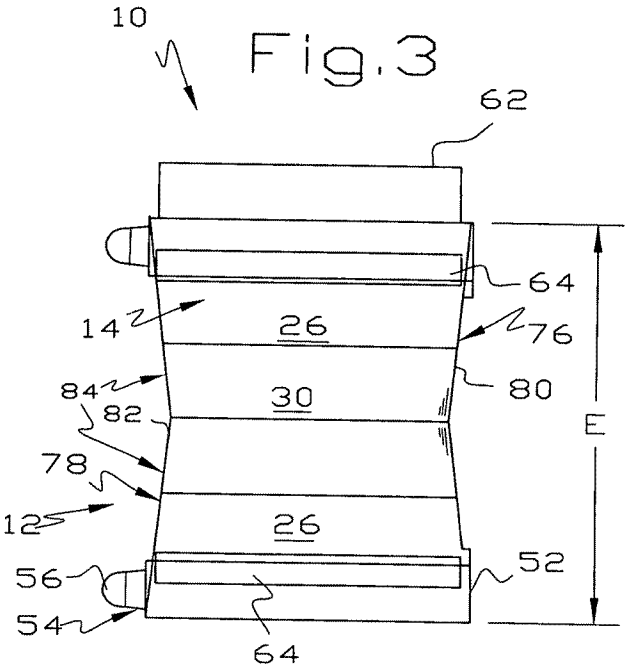
FIG. 3 is an end view of the chair of FIG. 1-2 illustrating another orientation in a foundation pour where the length of the chair is used to provide spacing of rebar from an underlying surface.

In some embodiments, the width and height of the rim 12 are reasonably close together and do not provide substantially different elevations of the rebar plane. In these situations, an acceptable device may be made with only two different elevations as shown by a chair 106 in FIG. 6 where the rebar supporting notches 40, 42 have been eliminated.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention.

I claim:

1. A chair for supporting reinforcing elements in a concrete pour on an underlying surface in a foundation pour mode and in a tilt wall pour mode, comprising a rim including first walls and second walls intersecting the first walls, the walls bounding a cavity;

a first of the first walls and a first of the second walls being configured to sup ort the rim on the underlying surface in response to orientation of the rim relative to the underlying surface, a second of the first walls and a second of the second walls each providing an outwardly facing depression configured to receive and support a concrete reinforcing element at different distances from the underlying surface in response to different orientations of the rim relative to the underlying surface in a foundation pour mode; and only the first of the first walls having a pair of spaced first feet extending away therefrom;

only a first of the second walls having a pair of second feet extending away therefrom;

the first feet being configured to raise the first of the first walls above the underlying surface when the first of the first walls adjoins the underlying surface and the second feet being configured to raise the first of the second walls above the underlying surface when the first of the second walls adjoins the underlying surface, the first and second feet being configured to position the reinforcing elements at different distances from the underlying surface in a tilt wall pour mode.

2. The chair of claim 1 further comprising spaced third feet located at a junction of the first and second walls, the third feet extending in only one direction away from intersecting edges of the first and second walls, the third feet being configured to stack one chair upon another, the third feet being configured to space the first and second walls above the underlying surface.

3. The chair of claim 1 wherein the first walls include upper and lower edges providing a first depression and a second depression and further comprising third spaced feet extending away from a rim of the first and second walls, the third feet being configured to place the first and second depressions at different distances fro the underlying surface in response to orientation of the rim.

4. The chair of claim 3 wherein the third feet provide a shank connected to the rim and being of predetermined cross-sectional area, the shank having a terminal end, the terminal end being a smooth curvilinear point.

5. The chair of claim 1 wherein the first feet comprise first rails extending along the first wall from adjacent one edge of the first wall to adjacent an opposite edge of the first wall and wherein the second feet comprise second rails extending along the second wall from adjacent one edge of the second wall to adjacent an opposite edge of the second wall.

6. The chair of claim 5 wherein the first rails are substantially parallel to one another.

7. The chair of claim 6 wherein the second rails are substantially parallel to one another.

8. A chair for supporting reinforcing elements in a concrete pour on a underlying surface, comprising a rim including first walls, second walls intersecting the first walls and a cavity between the walls, the walls including outwardly facing depressions configured to support a reinforcing element, the first walls including a pair of spaced edges providing depressions configured t support a reinforcing element, the walls including a length, width and height of different linear extent;

the depressions being configured to support a reinforcing element at three different distances from the underlying surface in response to orientation f the rim; and feet on the rim ex ending away from different sides of the rim, the feet and depressions being configured to support a reinforcing element at a plurality of different distances from the underlying surface in a tilt wall pour mode, the feet and depressions being configured to support a reinforcing element at a plurality of different spacings from the underlying surface in a foundation pour mode in response to different orientations of the rim;

wherein the feet comprise first spaced feet adjoining and extending generally perpendicularly away from only one of the first walls and second spaced feet adjoining and extending generally perpendicularly away from only one of the second walls, the first feet being configured to raise the first wall above the underlying surface and the second feet being configured to raise the second wall above the underlying surface in a different orientation of the rim.

9. A chair for supporting reinforcing elements in a concrete pour on a underlying surface, comprising a rim including first walls, second walls intersecting the first walls and a cavity between the walls, the walls including outwardly facing depressions configured to support a reinforcing element, the first walls including a pair of spaced edges providing depressions configured t support a reinforcing element, the walls including a length, width and height of different linear extent;

the depressions being configured to support a reinforcing element at three different distances from the underlying surface in response to orientation of the rim; and feet on the rim extending away from different sides of the rim, the feet and depressions being configured to support a reinforcing element at a plurality of different distances from the underlying surface in a tilt wall pour mode, the feet and depressions being configured to support a reinforcing element at a plurality of different spacings from the underlying surface in a foundation tour mode in response to different orientations of the rim;

wherein the first feet comprise first rails extending along t first wall from adjacent one edge of the first wall to adjacent an opposite edge of the first wall and wherein the second feet comprise second rails extending along the second wall from adjacent one edge of the second wall to adjacent an opposite edge of the second wall.

10. A chair for supporting reinforcing elements in a concrete pour on an underlying surface, comprising a rim including first walls, second walls intersecting the first walls and a cavity between the walls, the walls including outwardly facing depressions configured to support a reinforcing element, the first walls including a pair of spaced edges providing depressions configured t reinforcing element, the walls including a length, width and height of different linear extent;

the depressions being configured to support a reinforcing element at three different distances from the underlying surface in response to orientation if the rim; and feet on the rim extending away from different sides of the rim, the feet and depressions being configured to support a reinforcing element at a plurality of different distances from the underlying surface in a tilt wall pour mode, the feet and depressions being configured to support a reinforcing element at a plurality of different spacings from the underlying surface in a foundation pour mode in to different orientations of the rim;

wherein the plurality of different distances comprise three different distances and wherein the plurality of different spacings comprise three different spacings.

11. A chair for supporting reinforcing elements in a concrete pour on a underlying surface, comprising a rim including first walls, second walls intersecting the first walls and a cavity between the walls, the walls including outwardly facing depressions configured to support a reinforcing element, the first walls including a pair of spaced edges providing depressions configured t support a reinforcing element, the walls including a length, width and height of different linear extent;

the depressions being configured to su port a reinforcing element at three different distances from the underlying surface in response to orientation of the rim; and feet on the rim extending away from different sides of the rim, the feet and depressions being configured to support a reinforcing element at a plurality of different distances from the underlying surface in a tilt wall pour mode, the feet and depressions being configured to support a reinforcing element at a plurality of different spacings from the underlying surface in a foundation pour mode in response to different orientations of the rim;

wherein the feet comprise first spaced feet adjoining an extending generally perpendicularly away from one of the first walls and second spaced feet adjoining and extending generally perpendicularly away from one of the second walls, the first feet being configured to raise the first wall above the underlying surface and the second feet being configured to raise the second wall above the underlying surface in a different orientation of the rim.

12. The chair of claim 11 wherein the rim includes a second edge opposite from the first mentioned edges, and further comprising third spaced feet located on the second edge, the third feet extending away from the rim, the third feet being perpendicular to the fir t and second feet, the third feet being configured to stack one hair upon another.

13. The chair of claim 12 wherein the third feet provide a shank connected to the rim and being of predetermined cross-sectional area, the shank having a terminal end of cross-sectional area less than the predetermined cross-sectional area, the terminal end being a point.

14. The chair of claim 11 wherein the feet provide a shank connected to the rim and being of given cross-sectional area, the shank having a terminal end of substantially smaller cross-sectional area than the shank.

15. The chair of claim 11 wherein the distances are of a diff ent length than the spacings.

16. The chair of claim 11 further comprising spaced third feet located at a junction of the first and second walls, the third feet extending in only c ne direction away from intersecting edges of the first and second walls, the third feet being configured to stack one chair upon another, the third feet being configured to space the first and second walls above the underlying surface.

17. The chair of claim 11 wherein the first walls include upper and lower edges providing a first depression and a second depression and further comprising third spaced feet extending away from a rim of the first and second walls, the third feet being configured to place the first and second depressions at different distances from the underlying surface in response to orientation of the rim.

18. A chair for supporting reinforcing elements in a concrete pour on an underlying surface in a foundation pour mode and in a tilt wall pour mode, comprising a rim including first walls, second walls intersecting the first walls and a cavity between the walls, the walls having outwardly facing depressions configured to support a reinforcing element, the rim including a pair of spaced edges;

spaced first feet on only a first of the spaced edges and configured to position the first edge away from the underlying surface when the first feet adjoin the underlying surface, the first walls having a depression configured to support a reinforcing element when the first feet adjoin the underlying surface;

spaced second feet on only a first of the first walls, the second feet being configured to position the first of the first walls away from the underlying surface when the second feet adjoin the underlying surface, a second of the first walls having a depression configured t support a reinforcing element when the second feet adjoin the underlying surface.

19. The chair of claim 18 wherein a first of the first walls includes a depression configured to support a reinforcing element in foundation pour when the second feet are in an orientation with the second feet spaced from the underlying surface.

20. The chair of claim 18 wherein the first wall includes a depression between the first feet configured to support a reinforcing element in a foundation pour when the first feet are in an orientation with the first feet spaced from the underlying surface.

* * * * *